United States Patent [19]

Ying

[11] Patent Number: 4,697,701

[45] Date of Patent: Oct. 6, 1987

[54] DUST FREE STORAGE CONTAINER FOR A MEMBRANE ASSEMBLY SUCH AS A PELLICLE AND ITS METHOD OF USE

[75] Inventor: Minghaw Ying, Los Altos, Calif.

[73] Assignee: Inko Industrial Corporation, Sunnyvale, Calif.

[21] Appl. No.: 868,838

[22] Filed: May 30, 1986

[51] Int. Cl.[4] ..... B65D 85/38

[52] U.S. Cl. ..... 206/316; 206/460

[58] Field of Search ..... 206/521, 585, 507, 316, 206/334, 460, 328, 444, 445, 449, 813, 455, 303

[56] References Cited

U.S. PATENT DOCUMENTS

| | | | |
|---|---|---|---|
| 3,645,281 | 2/1972 | Seidler | 206/460 X |
| 3,645,388 | 2/1972 | Fessenden | 206/455 |
| 4,008,802 | 2/1977 | Preitag | 206/63.3 |
| 4,054,678 | 10/1977 | Benjamin et al. | 426/653 |
| 4,131,363 | 12/1978 | Shea et al. | 355/75 |
| 4,194,228 | 3/1980 | Duff | 206/444 X |
| 4,207,376 | 6/1980 | Nagayasu et al. | 428/367 |
| 4,353,466 | 10/1982 | Pater | 206/460 X |
| 4,378,953 | 4/1983 | Winn | 350/1.1 |
| 4,426,000 | 1/1984 | Dunn | 206/455 |
| 4,465,759 | 8/1984 | Duly et al. | 430/321 |
| 4,470,508 | 9/1984 | Yen | 206/334 |
| 4,482,591 | 11/1984 | Ward | 428/66 |
| 4,491,225 | 1/1985 | Baillod | 206/583 |
| 4,585,121 | 4/1986 | Capelle, Jr. | 206/583 X |
| 4,609,105 | 9/1986 | Manes et al. | 206/444 |

FOREIGN PATENT DOCUMENTS

| | | | |
|---|---|---|---|
| 231487 | 11/1925 | United Kingdom | 206/455 |

OTHER PUBLICATIONS

IBM Technical Disclosure Bulletin, Vol. 23, No. 11 Apr. 1981 pp. 4934–4935.

*Primary Examiner*—Stephen Marcus
*Assistant Examiner*—T. Graveline
*Attorney, Agent, or Firm*—Flehr, Hohbach, Test, Albritton & Herbert

[57] ABSTRACT

A dust free container is disclosed herein for storing an optical membrane assembly such as a pellicle after the assembly is manufactured but before the latter is placed into use. The optical membrane assembly is one which includes a circumferential frame having a front side and a back side and an optical membrane mounted to and extending across the entire extent of the frame. The container, which is preferably black in color along substantially its entire extent, includes a base member defining an upwardly facing circumferential shoulder. This shoulder supports the front side of the circumferential frame forming part of the overall membrane assembly along its entire extent such that the front face of the optical membrane is maintained in spatial relationship with the rest of the base member. A seal is provided between and along the entire extent of the upwardly facing shoulder and the circumferential frame forming part of the overall optical membrane assembly, whereby to seal closed the front face of the optical membrane within the base member. A cover, which also forms part of the container, is disposed over the base member and the entire optical membrane assembly.

15 Claims, 3 Drawing Figures

DUST FREE STORAGE CONTAINER FOR A MEMBRANE ASSEMBLY SUCH AS A PELLICLE AND ITS METHOD OF USE

The present invention relates generally to optical membrane assemblies such as a pellicle and more particularly to a technique for storing such an assembly in a dust free environment between the time the assembly is manufactured and its placed into use.

Optical membranes and specifically pellicles are known in the art. One such optical membrane including its method of manufacture is described in U.S. Pat. Nos. 4,378,953. Other pellicles are described in U.S. Pat. Nos. 4,465,759, 4,131,363 and 4,482,591. The need to maintain a pellicle in a dust free environment between the time it is manufactured and the time it placed into use is also known in the art. A specific packaging container for optical membranes such as pellicles is disclosed in U.S. Pat. No. 4,470,508 which issued to Micro Lithography, Inc. (MLI) on Sept. 11, 1984. An actual working embodiment of a prior art MLI pellicle containing package is also described in the MLI brochure entitled THE CLEANEST PELLICLE IN THE CLEANEST PACKAGE. As will be discussed in more detail below, the present invention provides what applicant believes to be a significant improvement over the packaging techniques in the prior art and particularly the one described in the MLI patent and brochure.

For purposes of the present invention, it is not important to describe the structural details of a pellicle and its intended use, as both are known in the art, as stated above. It suffices to say that the pellicle itself can be comprised of a relatively rigid circumferential frame or rim, for example annular or rectangular, having a front side and a back side and an optical membrane mounted to and extending across the entire extent of the frame and having a front face and a back face. The pellicle typically is used in the semi-conductor industry as a dust cover for a photomask. The front side of the frame is mounted or otherwise held to a face of the photomask around the critical area of the latter, that is the area to be exposed, and the optical membrane extends over and covers the critical area, thereby providing a protective cover against ambient dust.

As used herein, ambient dust refers to all types of ambient particles, particularly air borne particles which might find their way onto the pellicle surface area of the photomask including particles as small as 1 micron. While it is desirable to maintain the back face of the pellicle's optical membrane dust free, it is critical that its front face remain so. This is because the dust on the front face would possibly fall onto the photomask and seriously adversely affect the overall exposure process since the photomask is on the image plane of the process. While it is not desirable to have dust on the back face of the pellicle's optical membrane, the presence of dust there is not as critical since the dust is spaced a relatively large distance from the photomask and thus the image plane of the overall exposure process and therefore will not effect the latter as much. The specific disadvantage in using a packaging container of the type described in the above recited MLI patent and brochure is that such a package does not take into account this critical difference.

Rather, the packaging container described in the MLI patent and brochure relies on layers of adhesive on the internal surfaces of its assembly package above and below the pellicle membrane to capture any airborne dust without protecting the front face of the membrane to a greater extent than the back face.

In view of the foregoing, it is an object of the present invention to provide an improved dust free packaging technique for pellicles and optical membrane assemblies in general.

Another object of the present invention is to provide the last mentioned technique in an uncomplicated, economical and yet reliable way.

A more particular object of the present invention is to provide a technique for storing the pellicle or similar optical membrane assembly in a way which, from the standpoint of dust protection, favors one side of the pellicle or other such assembly over an opposite side.

Another particular object of the present invention is to provide a packaging technique which makes it relatively easy to inspect for dust on the internal surfaces of the package.

Still another particular object of the present invention is to provide a packaging container and an optical membrane assembly which is specifically designed to display reduced and preferably no attraction at all for ambient dust.

As will be seen hereinafter, the packaging container disclosed herein is one which is especially suitable for use with a pellicle or other such optical membrane assembly including a circumferential frame having a front side and a back side and an optical membrane mounted to and extending across the entire extent of the frame and having a front face and a back face. In the case of a pellicle, the front face of its optical membrane is the critical surface described previously, that is, the surface is confronting relationship with the photomask or like working surface. The container disclosed herein includes a base member defining an upwardly facing circumferential shoulder supporting the front side of the pellicle's circumferential frame along its entire extent such that the front or critical face of the optical membrane is maintained in spatial relationship with the rest of the base member. The container also includes a cover disposed over the base member and the entire pellicle. In accordance with the present invention, a seal is provided and extends between and along the entire extent of the front side of the pellicle's circumferential frame and the base member's upwardly facing shoulder whereby to seal closed the front or critical face of the pellicle within the base member.

In an actual working embodiment of the present invention, the seal between the pellicle frame and the container's upwardly facing shoulder is in the form of a continuous strip of adhesive and in a most preferred embodiment, this continuous strip of adhesive is permanently affixed to the pellicles frame and also serves to bond the pellicle to another working surface such as a photomask when the pellicle is placed in use. In this same preferred embodiment, the cover forming part of the overall container disclosed herein includes circumferential rib means serving to apply force against the back side of the pellicle's frame so as to urge the latter in the direction of the base member's circumferential shoulder, whereby to enhance the sealing capability of the sealing means.

Still referring to the preferred embodiment of the packaging container disclosed herein, substantially all of its interior surfaces, that is, the surfaces making up its base member and its cover, are colored black in a preferred embodiment but may incorporate other dark colors. This particular color is best for showing any ambient dust which might have accumulated on the surfaces and therefore makes visual inspection for accumulated dust, even minute particles as small as 10 micron, relatively easy. At the same time, these surfaces preferably contain a coating of anti-static material so as to minimize and preferably entirely eliminate any attraction between the surfaces and any airborne ambient dust. Moreover, the optical membrane itself which forms part of the overall pellicle is preferably formed of a composition which includes an anti-static substance provided integrally throughout the body of the membrane, thereby minimizing and, again, preferably entirely eliminating the attraction between the membrane itself and any airborne dust.

The present invention will be described in more detail hereinafter in conjunction with the drawing wherein.

Figure 1:
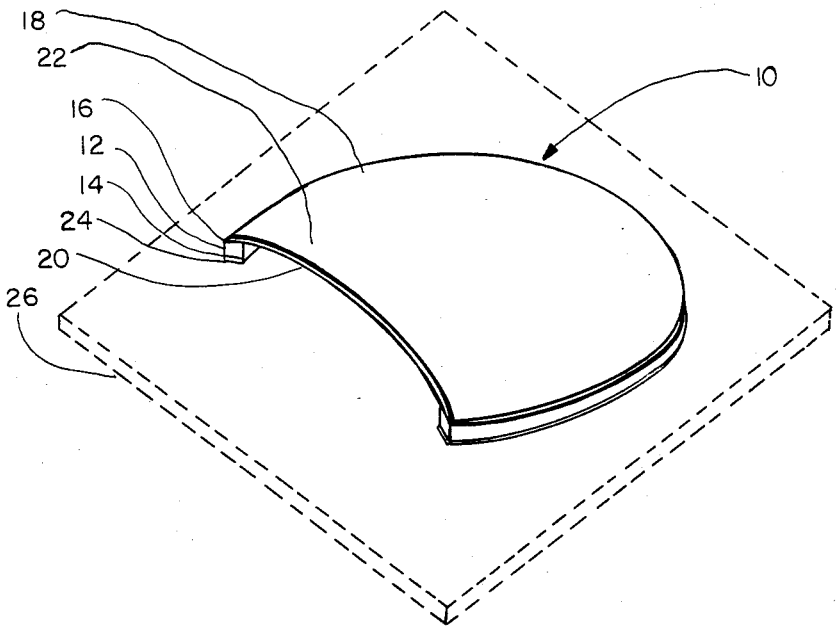
FIG. 1 is a partially broken away perspective view of a pellicle designed in accordance with the present invention.

Turning now to the drawings, wherein like components are designated by like reference numerals throughout the three figures, attention is first directed to FIG. 1. This figure illustrates a pellicle which is designed in accordance with the present invention and which is generally indicated by the reference numeral 10. The pellicle is shown including an annular frame or rim 12 which is designed of any suitable, relatively rigid material, for example, plastic, and which includes what will be referred to a flat front side 14 and an opposite, flat backside 16. An optical membrane 18 is mounted to and extends across the entire extent of the backside 16 of frame 12 and includes its own front face 20 and back face 22. While frame 12 and membrane 18 are shown annular in configuration, it is to be understood that they could be rectangular, square or any other suitable shape.

The optical membrane 18 may be made of any suitable material and in any suitable manner, for example as described in the previously recited United States Patents. However, in accordance with one aspect of the present invention, the composition making up the membrane preferably contains an anti-static substance which is incorporated into the composition in the beginning of the forming process so that the anti-static substance is provided integrally throughout the body of the membrane as the latter is formed. For example, in the process outline in the U.S. Pat. No. 4,378,953, the optical membrane described there is formed from a flowable composition applied to a rotating support surface which, in turn, forms the ultimate membrane. In that process, the anti-static substance would be incorporated into the flowable composition before it is applied to the rotating substrate. Examples of an actual working anti-static substance are stearic acid, polyacrylic acid, static rescue and staticide.

Still referring to FIG. 1, pellicle 10 is shown including a layer of adhesive fixedly connected to and extending the entire extent of front face 14 of frame 12. This adhesive which may be, for example, conventional double sided tape such as one manufactured by 3M company, product number 447, is typically provided along the front face of a pellicle's frame to aid in adhering the pellicle to its working surface, for example, to the face of a photomask which is generally illustrated by dotted lines in FIG. 1 at 26. Note that the front face 20 of optical membrane 18 is in direct confronting relationship with the photomask 26. Thus, front face 20 is considered to be the critical face of the pellicle, as described previously. As will be seen hereinafter, in accordance with another feature of the present invention, adhesive 24 not only eventually serves to attach pellicle 10 to its working surface, e.g., the photomask 26, but also as an important seal in the overall packaging of the pellicle between the time it is manufactured and the time it is ultimately used.

Figure 2:
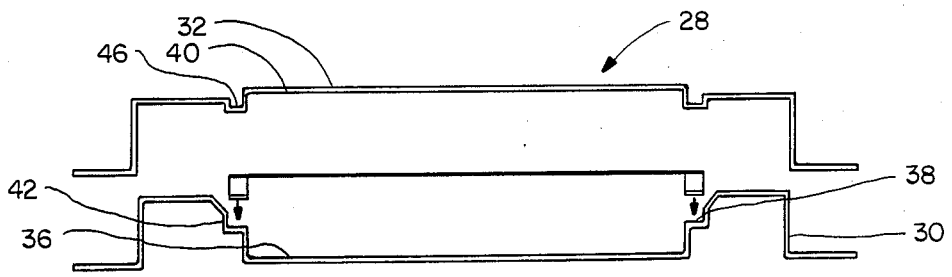
FIG. 2 is a cross sectional view of the pellicle illustrated in FIG. 1 in combination with a packaging container designed in accordance with the present invention, the container and pellicle being shown in an unassembled state.
Figure 3:
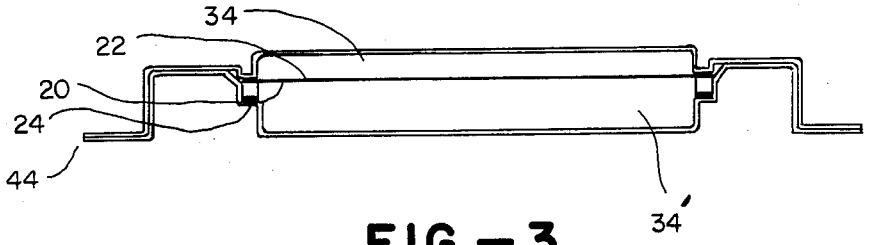
FIG. 3 is a view similar to FIG. 2 but showing the container assembled and the pellicle in its storage position therein.

Turning now to FIGS. 2 and 3, attention is directed to a packaging container which is designed in accordance with the present invention for storing pellicle 10 prior to it being placed into use. The container is shown in FIGS. 2 and 3 including a base member 30 and a cover 32, each of which may be made of any suitable, relatively rigid material such as PVC plastic. As will be seen below, base member 30 and cover 32 cooperate with one another to provide a storage compartment 34 for containing pellicle 10 in a dust free environment. To this end and in accordance with still another feature of the present invention, the internal surfaces of the base member and cover including specifically those surfaces which define compartment 34 are colored black (or other dark color such as dark blue, brown or red) and preferably all of the surfaces of the overall container are colored black (or other such dark color) for the reasons described previously. Moreover, the internal surfaces of the base member and particularly the internal surfaces defining compartment 34 are coated with an anti-static substance, for example the ones mentioned above, again for the reasons recited previously.

Referring specifically to FIG. 2, base member 10 is shown including a lowermost or bottom internal surface 36 which is surrounded by a vertically upwardly spaced, vertically upwardly facing annular shoulder 38 which is configured to support the adhesive containing front face 14 of support frame 12 forming part of pellicle 10 as best illustrated in FIG. 3. As a result, the layer of adhesive 24 extends between and along the entire extent of front side 14 of frame 12 and shoulder 38 and, in accordance with the present invention, serves as a dust seal therebetween. As a result, the front face 20 of pellicle 10 is tightly sealed within its open dust proof compartments 34' in base member 30.

As illustrated in both FIGS. 2 and 3, cover 32 is designed to fit over base member 30. To this end, the cover includes a top end 40 and an outer circumferential rim 42 which is designed to fit around the outer periphery of the base member, as specifically shown in FIG. 3. The base member and cover are designed so that this fit is relatively tight. At the same time, readily removable sealing tape 44 can be applied across the outer joint between base member 30 and cover 32, as shown in FIG. 3. In addition, cover 40 is shown including an inner, downwardly projecting annular rib 46 in confronting relationship with the back side 16 of frame 12. As illustrated specifically in FIG. 3, rib 46 engages back side 16 of the frame along its entire extent and urges the latter downward against shoulder 38. This improves the seal between shoulder 38 and the front side 14 of the frame.

It should be apparent from the foregoing description of packaging container 28 that this cover and base serve as a means for containing pellicle 10 in a relatively dust free environment. However, it should be equally clear that the packaging container provides a greater degree of protection to front face 20 of the pellicle's optical membrane than backface 22, due to the positional relationship of the pellicle within the container and the use of seal 24. In actual practice, the pellicle is manufactured and packaged in a clean room before this is done and the container itself is carefully inspected for ambient dust and this is made easier when the container is colored black.

While container 28 has been described in conjunction with a pellicle 10, it is to be understood that the container is equally applicable with other types of optical membrane assemblies, especially those which have a critical side to be protected against ambient dust to a greater extent than an opposite side. Also, while a seal described above is composed of the adhesive layer 24 which serves not only as a seal but as a means for adhering the pellicle to its working surface, it is to be understood that the present invention is not limited to such a seal. If a particular optical membrane assembly does not include such adhesive or it is found not to be satisfactory as a seal, container 28 could be provided with its own separate and distinct seal. For example a rubber washer type of o-ring could be utilized between shoulder 38 and the front side 14 of frame 12 with the annular rib 46 applying sufficient force to the backside of the frame to create a reliable seal across the washer.

What is claimed is:

1. An optical membrane assembly package, comprising: an optical membrane assembly including a circumferential frame having a front side and a back side and an optical membrane mounted to and extending across the entire extent of said frame; a container for storing said optical membrane assembly until the latter is placed into use, said container including a base member defining an upwardly facing circumferential shoulder supporting the front side of said circumferential frame along its entire extent such that the front or critical face of said optical membrane is maintained in spatial relationship with the rest of said base member, said container also including a cover disposed over said base member and the entire optical membrane assembly, and seal means disposed between and extending along the entire extent of the front side of said circumferential frame and said shoulder whereby to serve as a seal between the frame's front side and said shoulder in order to seal closed the front face of said optical membrane within said base member said sealing means being in the form of a continuous strip of adhesive which also serves to bond the optical membrane assembly to another surface such as a photomask when the assembly is placed in use.

2. A package according to claim 1 wherein the entire inner surface of each of said base members and said cover is colored black.

3. A package according to claim 1 wherein substantially the entire inner surface of each of said base member and said cover is coated with an antistatic coating.

4. A package according to claim 1 wherein said optical membrane is formed of a composition which includes an antistatic substance provided integrally throughout the body of said membrane.

5. A package according to claim 1 wherein said cover includes circumferential rib means for pressing down on the backside of said frame whereby to squeeze said sealing means between said frame's front side and said shoulder in order to enhance the sealing capability of said sealing means.

6. A package according to claim 1 wherein said optical membrane assembly is a pellicle and wherein the front face of said optical membrane is intended to be placed in direct confronting relationship with a photomask or other such working surface to be protected from ambient dust and other such particles.

7. A pellicle package assembly, comprising: a pellicle including a circumferential frame having a front side and a back side and an optical membrane mounted to and extending across the entire extent of said frame and including a front or critical face and a back face; a container for storing said pellicle until the latter is placed into use, said container including a base member having an internal surface substantially all of which is colored black and defining an upwardly facing circumferential shoulder supporting the front side of said circumferential frame along its entire extent such that the front face of said optical membrane is maintained in spatial relationship with the rest of the base member, said container also including a cover disposed over said base member and said pellicle and having an internal surface, substantially all of which is colored black, said cover also including circumferential rib means pressing down on the back side of said pellicle, in order to urge the latter against said circumferential shoulder; and seal means located within said container and extending between and along the entire extent of the front side of said circumferential frame and said shoulder whereby to seal closed the front face of said optical membrane, said sealing means being in the form of a continuous strip of adhesive which also serves to bond the pellicle to the photomask or other such working surface when the assembly is placed in use.

8. A pellicle package according to claim 7 wherein substantially all of the inner surface of each of said base member and said cover member is coated with an anti-static coating and wherein said optical membrane is formed of a composition which includes an anti-static substance provided integrally throughout the body of said membrane.

9. A container for storing an optical membrane assembly such as a pellicle after the latter has been manufactured and before it is actually placed into use, said optical membrane assembly including a circumferential frame having a front side and a back side and an optical membrane with a front or critical face and a back face and mounted to and extending across the entire extent of said frame, said container comprising; a base member defining an upwardly facing shoulder configured to support the front side of said circumferential frame along its entire extent such that the front face of said optical membrane is maintained in spatial relationship with the rest of said base member; a cover disposed over said base member and its upwardly facing circumferential shoulder and cooperating with said base member so as to provide an internal compartment sufficiently large to receive said optical membrane assembly; and a continuous layer of adhesive sealing material located between and along the entire extent of said shoulder and the front side of the circumferential frame forming part of said optical membrane assembly when the latter is located within said container, whereby to provide a seal for closing the front face of said optical membrane within said base member said continuous layer of adhesive material being permanently affixed to the front side of said circumferential frame, whereby to also serve as a means of bonding the optical membrane assembly to another surface such as a photomask when the assembly is placed in use.

10. A container according to claim 9 wherein the entire inner surface of each of said base member and said cover is colored a dark color, selected from black, dark blue, dark brown or dark red.

11. A container according to claim 9 wherein substantially the entire inner surface of each of said base member and said cover is coated with an anti-static coating.

12. A container according to claim 9 wherein said cover includes circumferential rib means for pressing down on and directly against the back side of said circumferential frame when the optical membrane assembly is disposed within said container, whereby to enhance the sealing capability of said sealing material.

13. A method of packaging an optical membrane assembly such as a pellicle including a circumferential frame having a front side and a back side and an optical membrane mounted to and extending across the entire extent of said frame and having a front or critical face and a back face, said method comprising the steps of: providing a container including a base member defining an upwardly facing circumferential shoulder; supporting the optical membrane assembly within said base member such that the front side of said circumferential frame is supported along its entire extent on said circumferential shoulder and such that the front face of said optical membrane is maintained in spatial relationship with the rest of said base member; providing a layer of adhesive sealing material between and along the entire extent of the front side of said circumferential frame and said shoulder whereby to seal closed the front face of said optical membrane within said base member; and covering the top of said base member by means of a cover forming part of the container said continuous layer of adhesive material being permanently affixed to the front side of said circumferential frame, whereby to also serve as a means of bonding the optical membrane assembly to another surface such as a photomask when the assembly is placed in use.

14. A method according to claim 13 including the step of applying force to and along the entire extent of the back side of said circumferential frame in the direction of said circumferential shoulder by means forming part of said cover, whereby to enhance the seal between said circumferential frame and said shoulder.

15. A method according to claim 13 wherein said optical membrane assembly is a pellicle and wherein the front face of said optical membrane is intended to be placed in direct confronting relationship with a photomask or other such working surface to be protected from ambient dust and other such particles.

* * * * *